US007468019B2

(12) United States Patent
Zylstra

(10) Patent No.: US 7,468,019 B2
(45) Date of Patent: Dec. 23, 2008

(54) NECK EXERCISE MACHINE

(76) Inventor: Dirk Zylstra, 1667 S. State, Ionia, MI (US) 48846

( * ) Notice: Subject to any disclaimer, the term of this patent is extended or adjusted under 35 U.S.C. 154(b) by 0 days.

(21) Appl. No.: 11/818,251

(22) Filed: Jun. 14, 2007

(65) Prior Publication Data

US 2008/0119331 A1 May 22, 2008

Related U.S. Application Data

(60) Provisional application No. 60/866,334, filed on Nov. 17, 2006.

(51) Int. Cl.
*A63B 23/025* (2006.01)
*A63B 21/02* (2006.01)
*A63B 21/04* (2006.01)

(52) U.S. Cl. ..... 482/10; 482/124; 482/130

(58) Field of Classification Search ..... 482/10, 482/122–124, 129, 130; 602/32–36; 606/240–242; 601/39

See application file for complete search history.

(56) References Cited

U.S. PATENT DOCUMENTS

| | | | | |
|---|---|---|---|---|
| 3,709,217 | A * | 1/1973 | Powers | 602/32 |
| 4,645,198 | A * | 2/1987 | Levenston | 482/10 |
| 5,242,347 | A * | 9/1993 | Keeton | 482/102 |
| 5,549,533 | A * | 8/1996 | Olson et al. | 482/137 |
| 5,893,818 | A * | 4/1999 | Zahiri et al. | 482/10 |
| 6,994,683 | B1 * | 2/2006 | Starr | 602/32 |

* cited by examiner

*Primary Examiner*—Loan H Thanh
*Assistant Examiner*—Allana Lewin
(74) *Attorney, Agent, or Firm*—Bruce A. Lev

(57) ABSTRACT

A neck exercise machine including a frame, a seat, a set of pulleys, a head band, an adjustable tensioner, and a cable adjustably attached to the head band, threaded through the pulleys, and removably connected to the adjustable tensioner, such that when a user sits in the seat and attaches the head band, they can exercise their neck muscles in a variety of different angles, rotations, and tensions. Elastic bands, an analog/digital force gauge, or hydraulic cylinder may be used as the adjustable tensioner and incorporate processor, memory, and data output mechanisms for performance analyses. The machine can also be broken down into numerous parts for easy transport and reassembly.

3 Claims, 3 Drawing Sheets

NECK EXERCISE MACHINE

PRIORITY

Priority is claimed to Provisional Patent Application No. 60/866,334 filed on Nov. 17, 2006

DESCRIPTION

1. Field of Invention

This invention is an apparatus which aids in the exercise and rehabilitation of the neck, cervical spine, and adjacent muscular groups. The configuration allows for adjusting the angle and amount of tension that is applied thereto and can be analyzed and easily modified.

2. Background of the Invention

Neck and spinal injuries have plagued man throughout history. Rehabilitation has always been difficult and often the exercises, machines, and apparati cause more damage to the effected and surrounding areas than actual healing and strengthening. Many machines and apparati have been developed over the years that would only offer specific directional resistance and be limited to only a certain amount or type of tension. Even further, the patient would most often need to travel to and from their place of rehabilitation thereby resulting in many missed therapy sessions.

Therefore, there became an urgent need for an exercise machine that could provide exercise and adjustable resistances in every direction and motion necessary, including moving ones head from side to side, forward and backward, and rotating from left to right and right to left. Further, there became an urgent need for the ability to monitor, analyze, and adjust the tension. Even further, there became an urgent need to make a machine that could be easily disassembled, transported, and reassembled.

Previous machines and apparati that do not incorporate the novel features of the instant invention that are within the field include the following:

U.S. Pat. No. 4,066,259

This apparatus is not portable and needs to be attached to the surface of a wall, it does not provide a full range of motion, including around the lateral axis (lateral rotation), and there is no measurement or calibration of restive/muscle strength.

U.S. Pat. No. 6,152,857

This apparatus is not intended for rehabilitation of the cervical spine, and is difficult to transport.

U.S. Pat. No. 4,789,154

This apparatus is not intended for rehabilitation of the cervical spine, the force needed is provided by other body parts of the user, therefore a person without arms cannot use this device, there is no measurement or calibration of restive/muscle strength, it cannot be used following neck trauma, and it can be dangerous to the cervical spine.

U.S. Pat. No. 4,832,333

This apparatus does not offer measurement or calibration of restive/muscle strength, the force needed is provided by other body parts of the user, therefore a person without arms cannot use the device, and the cervical spine cannot be exercised independently.

U.S. Pat. No. 4,893,808

This apparatus is only for use within a clinic and under supervision, it is used only for diagnostic purposes and not as an exercise machine, it needs electrical wiring, actuators, and counterweights to be operational, and offers limited freedoms of movement.

U.S. Pat. No. 6,106,437

This apparatus is not portable since it needs to be fastened to a wall surface, resistance is not calibrated or measured, it cannot objectively measure the isometric strength of the cervical spine to determine the specific level of rehabilitation or exercise resistance, and it needs a separate operator to set up and aid a patient to use the machine.

SUMMARY OF THE INVENTION

This invention essentially consists of a modular frame that can be easily disassembled, transported, and reassembled, a seat adjustably attached to the frame, a set of pulleys attached to the frame, a head band, an adjustable tensioning means, and a cable adjustably attached to the head band, threaded through the pulleys, and removably connected to the adjustable tensioning means, such that when a user sits in the seat and attaches the head band, the user can exercise their neck muscles by moving their head, neck, and torso in a variety of directions, and thereby creating tension through the cables and into the adjustable tensioning means, wherein the tension applied to the muscles of the user are in proportion to the chosen amount of tension set by the user and applied by the adjustable tensioning means.

One advantage over the prior machines and apparati is that this machine can provide tension to a users head in any direction desired, including side to side, forward and backward, and rotating from left to right and right to left, while retaining the appropriate tension at all times.

Another advantage is that the tension can be monitored, analyzed, and modified when necessary.

A further advantage is that this apparatus can be easily disassembled, transported, and reassembled. Nearly all of the previous machines that concentrated on the rehabilitation of these types of injuries are very large and are nearly immovable by hand.

The novel features of the present invention are set forth in the claims herein. The functionality, modes of operation, purposes, and advantages of this invention can be further understood with reference to the following drawings and description of the preferred embodiment.

DESCRIPTION OF THE PREFERRED EMBODIMENT

Figures 1A, 1B:
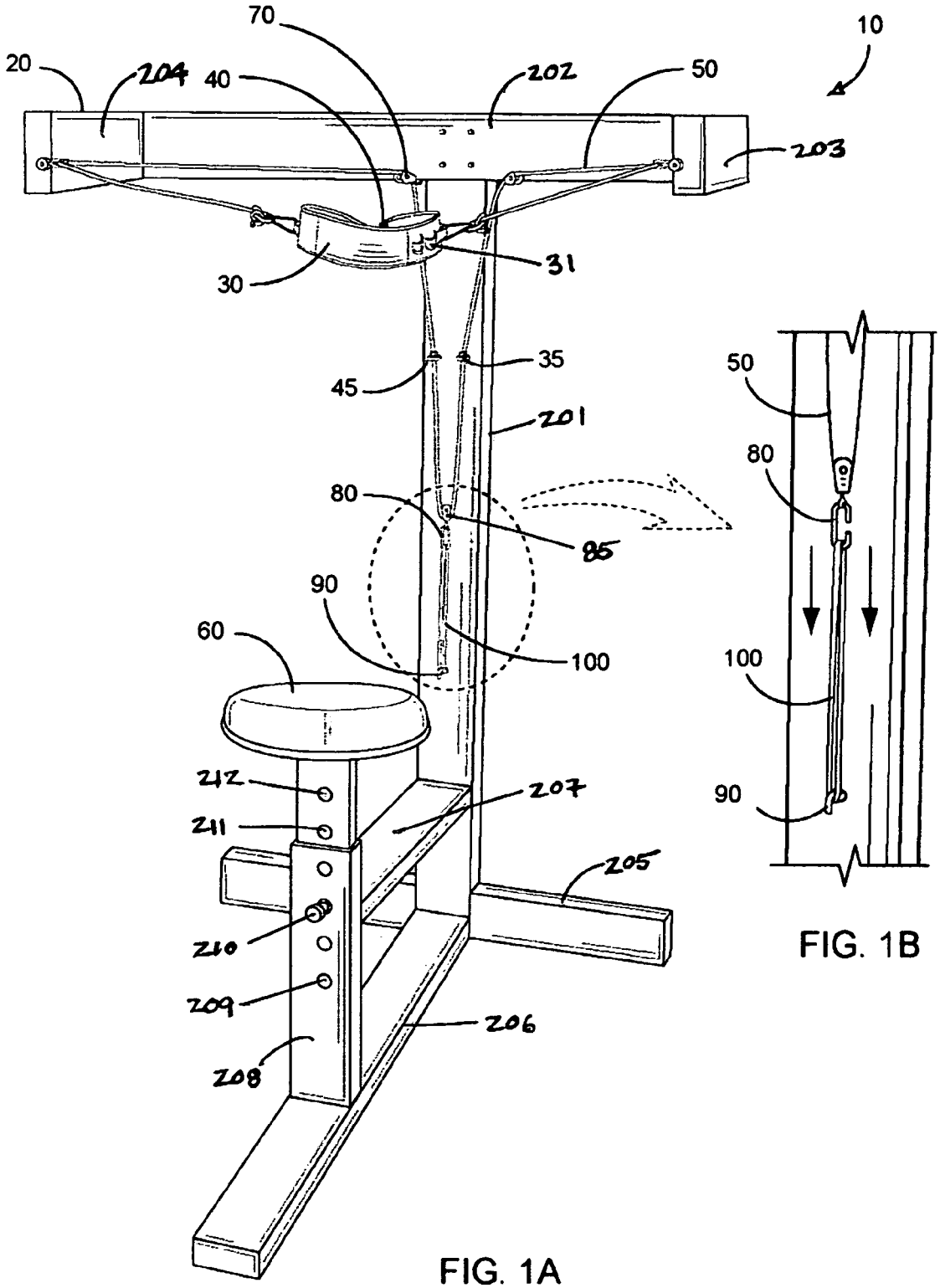
FIG. 1A is a perspective view of the neck exercise machine completely assembled and using a tensioning band as the tensioning means.
FIG. 1B is an enlarged perspective view of the tensioning band as the tensioning means
Figure 1D:
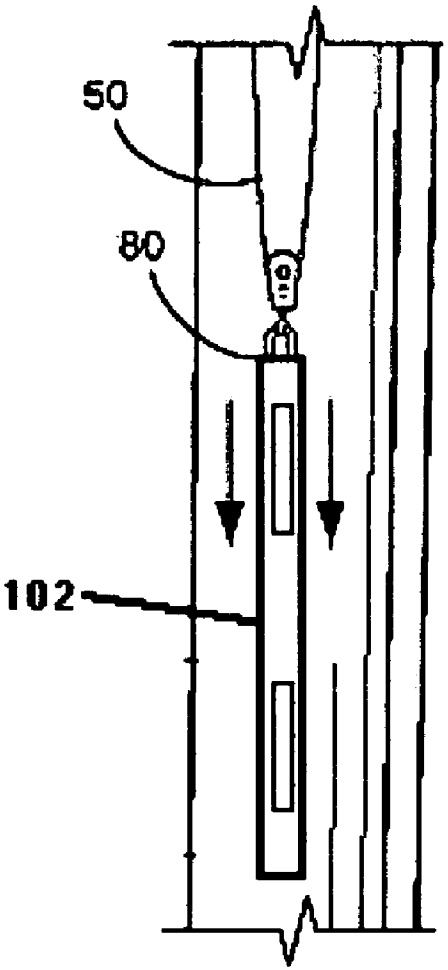
FIG. 1D is an enlarged perspective view of an analog/digital force gauge as the tensioning means.
Figure 1C:
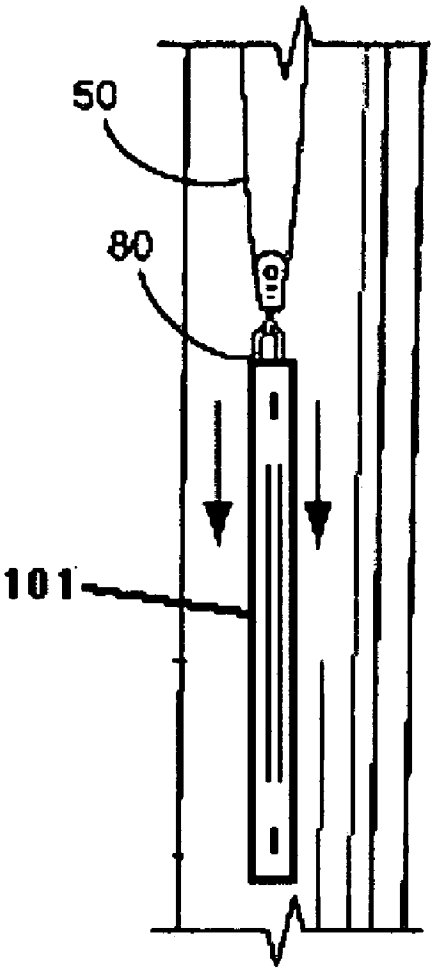
FIG. 1C is an enlarged perspective view of a hydraulic cylinder as the tensioning means.
Figure 2:
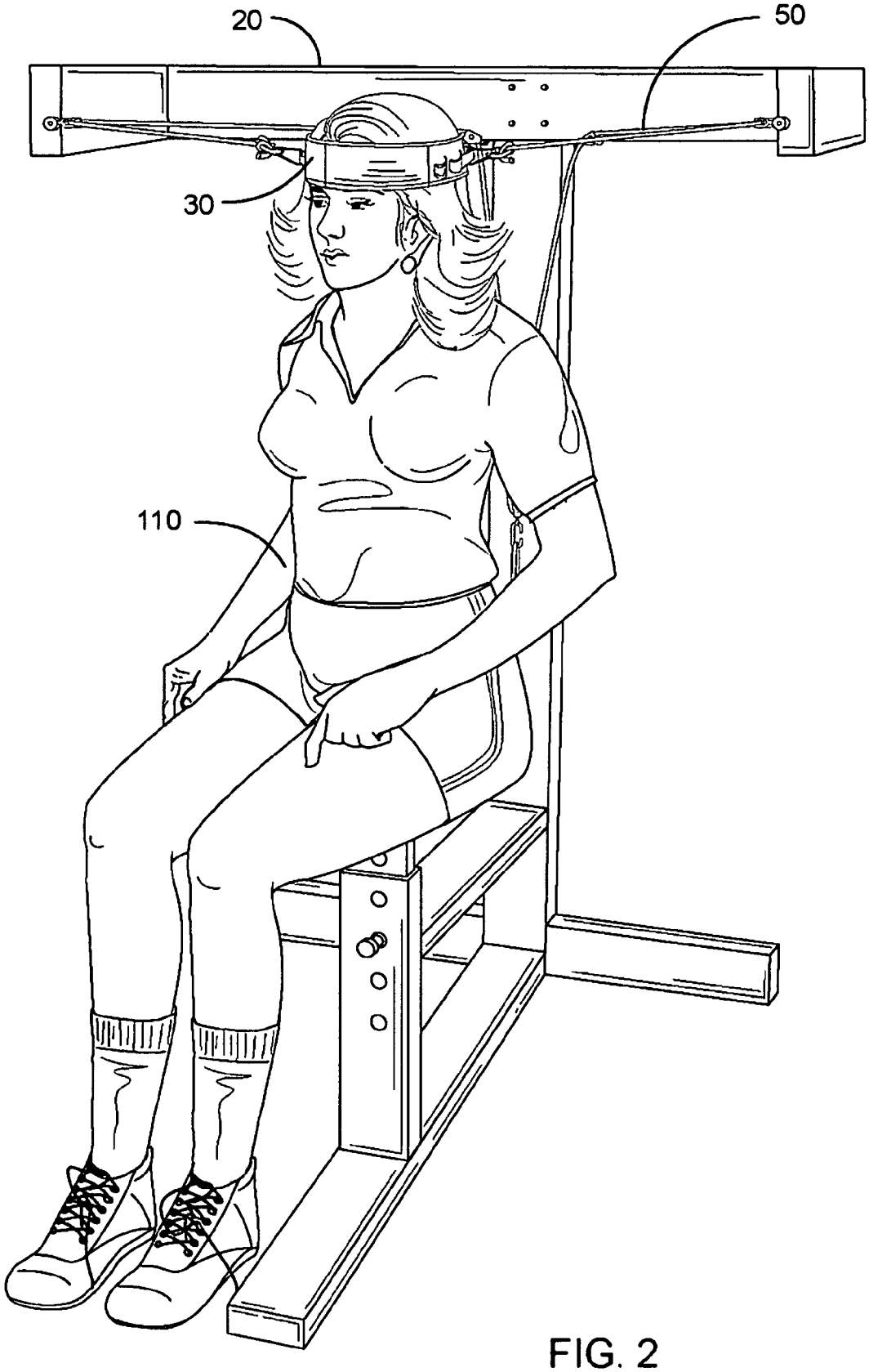
FIG. 2 is a perspective view illustrating a person using the neck exercise machine with the neck strap around her head.

The neck exercise machine as set forth herein is generally indicated by reference numeral 10 in FIG. 1A. The preferred embodiment comprises a frame (20) that includes a main vertical center support (201), an upper main horizontal support (202) attached at a center point to the top of the main vertical center support, left and right horizontal upper supports (203 and 204) extending perpendicularly from respective distal ends of the upper main horizontal support, wherein the left and right horizontal upper supports are extending in the same direction, a lower horizontal support (205) attached at a center point to the bottom of the main vertical center support and extending in the same plane as the upper main horizontal support, a second lower horizontal support (206) attached at a center point of the bottom of the main vertical center support and extending in the same direction as the left and right upper horizontal supports, a middle horizontal support (207) extending in the same plane and direction as the second lower horizontal support and attached to a section of the main vertical center support that is approximately one-fourth of the vertical height of the main vertical center support, a lower vertical seat support member (208) attached to a middle section of the second lower horizontal support and extending vertically upward and attaching to the outward distal end of the middle horizontal support, the lower vertical seat support member (208) further including a series of openings (209) aligned vertically along its length, and including a pin (210) for extending through one of the openings, and a seat (60) including a downward vertically extending seat support member (211) that fits and slides within the lower vertical seat support member, and further includes a series of openings (212) aligned vertically along its length, wherein the openings of the lower vertical seat support member align with the openings of the downward vertically extending seat support member, and wherein the pin is used to align chosen holes of the two seat supporting members, and thereby hold the two seat supporting members at a chosen vertical height.

The preferred embodiment further includes pulleys (70), including left and right fixed pulleys each extending from a respective distal end of the two horizontal upper supports; left and right fixed pulleys located at each of two equidistant points extending outward from the center point of the upper main horizontal support and facing the same direction as the horizontal upper support pulleys.

The preferred embodiment further includes left and right eyelets (45) fixedly attached to the main vertical center support at equidistant points extending outward from the main vertical center support's vertical center line, and at equidistant vertical distances that are at approximately two-thirds of the vertical height of the main vertical center support, and further facing the same direction as the horizontal upper support pulleys.

The preferred embodiment further includes an S-hook (90) fixedly attached to the main vertical center support at the main vertical center support's vertical center line and at approximately one-third of the vertical height of the main vertical center support, and further facing the same direction as the eyelets.

The preferred embodiment further includes a set of tensioning bands that are removable and interchangeable and vary in their elastic and tensioning qualities, wherein one tensioning band (100) is chosen and a portion of said one tensioning band is looped around the S-hook.

The preferred embodiment further includes a C-hook (80) having a lower portion hooking a portion of said tensioning band opposite from the S-hook.

The preferred embodiment further includes a C-hook pulley (85) attached to an upper portion of the C-hook.

The preferred embodiment further includes a head band (30) with a hook and loop adjustable strap (40), and including a series of attachment members (31) located at measured angular positions along left and right radial sections thereof.

The preferred embodiment further includes a cable (50) connected to an attachment member (31) at a chosen angular position of the left radial section of the head band, then extending through the left horizontal upper support pulley, then extending through the left upper main horizontal support pulley, then extending through the left main vertical center support eyelet, then extending through the C-hook pulley, then extending through the right main vertical center support eyelet, then extending through the right upper main horizontal support pulley, then extending through the right horizontal upper support pulley; then connected to an attachment member (31) at a chosen angular position of the right radial section of the head band.

The preferred embodiment further includes left and right stoppers (35) positioned and fixed upon the cable such that each stopper is slightly above a respective eyelet, wherein the stoppers are larger in diameter than the eyelets and will stop the movement of the cable when the tension in the cable is released.

The preferred embodiment is operational such that when a user (110) sits in the seat and attaches the head band, the user can exercise their neck muscles by moving their head, neck, and torso in a variety of directions, and thereby creating tension through the cables and into the tensioning band, wherein the tension applied to the muscles of the user are in proportion to the elastic qualities of the tensioning band chosen and installed; and wherein the user can interchange tensioning bands for differing desired tensions.

The parts of the frame of the preferred embodiment are detachably connected to one another using nuts and bolts, however, any other removable fasteners can be used that do not reduce the strength or integrity of the overall structure. Therefore, these parts can be easily connected or disconnected for convenient disassembly, transport, and reassembly. Once the frame is assembled, the pulleys are attached, the cable is threaded through the pulleys, and the headband is attached to the cable ends.

The headband can be made of hard plastic or steel with foam cushioning around the inside portion, and be adjustable to fit any size or shaped head.

As a further improvement, the tensioning bands can be replaced with an air or hydraulic cylinder (101) or an analog/digital force gauge (102) that can be removably attached to the frame by detachable fasteners. Further, these tensioning devices can further include processor, memory, and data output means in order to monitor and change the amount of tension required.

As a further improvement, the cable can be formed as a threaded band, or from any other advanced materials that transfer tensioning forces in a well controlled fashion.

As a further improvement, the neck exercise machine can also include means for evaluating the user's range of motion by incorporating travel distance measurements.

As a further improvement, the seat (60) can be replaced with a hydraulic seat including a back support and straps for immobilizing the shoulders of a user during neck movement.

The main purpose of the neck exercise machine is to provide a controlled and adjustable tension to a person's neck and cervical spine area, to thereby exercise and strengthen these areas in a predetermined and controlled method.

Any and all other obvious modifications to one or more of the parts of this invention are inherently incorporated herein.

What is claimed is:

1. A neck exercise machine comprising:

a frame including a main vertical center support; an upper main horizontal support attached at a center point to the top of the main vertical center support; left and right horizontal upper supports extending perpendicularly from respective distal ends of the upper main horizontal support, wherein the left and right horizontal upper supports are extending in the same direction; a lower horizontal support attached at a center point to the bottom of the main vertical center support and extending in the same plane as the upper main horizontal support; a second lower horizontal support attached at a center point of the bottom of the main vertical center support and extending in the same direction as the left and right upper horizontal supports; a middle horizontal support extending in the same plane and direction as the second lower horizontal support and attached to a section of the main vertical center support that is approximately one-fourth of the vertical height of the main vertical center support; a lower vertical seat support member attached to a middle section of the second lower horizontal support and extending vertically upward and attaching to the outward distal end of the middle horizontal support; the lower vertical seat support member further including a series of openings aligned vertically along its length, and including a pin for extending through one of the openings; and a seat including a downward vertically extending seat support member that fits and slides within the lower vertical seat support member, and further includes a series of openings aligned vertically along its length, wherein the openings of the lower vertical seat support member align with the openings of the downward vertically extending seat support member; and wherein the pin is used to align chosen holes of the two seat supporting members, and thereby hold the two seat supporting members at a chosen vertical height;

a set of pulleys, including left and right fixed pulleys each extending from a respective distal end of the two horizontal upper supports; left and right fixed pulleys located at each of two equidistant points extending outward from the center point of the upper main horizontal support and facing the same direction as the horizontal upper support pulleys;

left and right eyelets fixedly attached to the main vertical center support at equidistant points extending outward from the main vertical center support's vertical center line, and at equidistant vertical distances that are at approximately two-thirds of the vertical height of the main vertical center support, and further facing the same direction as the horizontal upper support pulleys;

an S-hook fixedly attached to the main vertical center support at the main vertical center support's vertical center line and at approximately one-third of the vertical height of the main vertical center support, and further facing the same direction as the eyelets;

a set of tensioning bands that are removable and interchangeable and vary in their elastic and tensioning qualities, wherein one tensioning band is chosen and a portion of said one tensioning band is looped around the S-hook;

a C-hook having a lower portion hooking a portion of said tensioning band opposite from the S-hook;

a C-hook pulley attached to an upper portion of the C-hook;

a head band including a series of attachment members located at measured angular positions along left and right radial sections thereof;

a cable connected to an attachment member at a chosen angular position of the left radial section of the head band, then extending through the left horizontal upper support pulley, then extending through the left upper main horizontal support pulley, then extending through the left main vertical center support eyelet, then extending through the C-hook pulley, then extending through the right main vertical center support eyelet, then extending through the right upper main horizontal support pulley, then extending through the right horizontal upper support pulley; then connected to an attachment member at a chosen angular position of the right radial section of the head band;

and left and right stoppers positioned and fixed upon the cable such that each stopper is slightly above a respective eyelet, wherein the stoppers are larger in diameter than the eyelets and will stop the movement of the cables when the tension in the cable is released;

such that when a user sits in the seat and attaches the head band, the user can exercise their neck muscles by moving their head, neck, and torso in a variety of directions, and thereby creating tension through the cables and into the tensioning band, wherein the tension applied to the muscles of the user are in proportion to the elastic qualities of the tensioning band chosen and installed; and wherein the user can interchange tensioning bands for differing desired tensions.

2. A neck exercise machine comprising:

a frame including a main vertical center support; an upper main horizontal support attached at a center point to the top of the main vertical center support; left and right horizontal upper supports extending perpendicularly from respective distal ends of the upper main horizontal support, wherein the left and right horizontal upper supports are extending in the same direction; a lower horizontal support attached at a center point to the bottom of the main vertical center support and extending in the same plane as the upper main horizontal support; a second lower horizontal support attached at a center point of the bottom of the main vertical center support and extending in the same direction as the left and right upper horizontal supports; a middle horizontal support extending in the same plane and direction as the second lower horizontal support and attached to a section of the main vertical center support that is approximately one-fourth of the vertical height of the main vertical center support; a lower vertical seat support member attached to a middle section of the second lower horizontal support and extending vertically upward and attaching to the outward distal end of the middle horizontal support; the lower vertical seat support member further including a series of openings aligned vertically along its length, and including a pin for extending through one of the openings; and a seat including a downward vertically extending seat support member that fits and slides within the lower vertical seat support member, and further includes a series of openings aligned vertically along its length, wherein the openings of the lower vertical seat support member align with the openings of the downward vertically extending seat support member; and wherein the pin is used to align chosen holes of the two seat supporting members, and thereby hold the two seat supporting members at a chosen vertical height;

a set of pulleys, including left and right fixed pulleys each extending from a respective distal end of the two horizontal upper supports; left and right fixed pulleys located at each of two equidistant points extending outward from the center point of the upper main horizontal support and facing the same direction as the horizontal upper support pulleys;

left and right eyelets fixedly attached to the main vertical center support at equidistant points extending outward from the main vertical center support's vertical center line, and at equidistant vertical distances that are at approximately two-thirds of the vertical height of the main vertical center support, and further facing the same direction as the horizontal upper support pulleys;

an analog/digital force gauge;

a head band including a series of attachment members located at measured angular positions along left and right radial sections thereof;

a cable connected to an attachment member at a chosen angular position of the left radial section of the head band, then extending through the left horizontal upper support pulley, then extending through the left upper main horizontal support pulley, then extending through the left main vertical center support eyelet, then removably connected to the digital force gauge, then extending through the right main vertical center support eyelet, then extending through the right upper main horizontal support pulley, then extending through the right horizontal upper support pulley; then connected to an attachment member at a chosen angular position of the right radial section of the head band;

and left and right stoppers positioned and fixed upon the cable such that each stopper is slightly above a respective eyelet, wherein the stoppers are larger in diameter than the eyelets and will stop the movement of the cables when the tension in the cable is released;

such that when a user sits in the seat and attaches the head band, the user can exercise their neck muscles by moving their head, neck, and torso in a variety of directions, and can easily monitor and adjust the amount of tension desired.

3. A neck exercise machine comprising:

a frame including a main vertical center support; an upper main horizontal support attached at a center point to the top of the main vertical center support; left and right horizontal upper supports extending perpendicularly from respective distal ends of the upper main horizontal support, wherein the left and right horizontal upper supports are extending in the same direction; a lower horizontal support attached at a center point to the bottom of the main vertical center support and extending in the same plane as the upper main horizontal support; a second lower horizontal support attached at a center point of the bottom of the main vertical center support and extending in the same direction as the left and right upper horizontal supports; a middle horizontal support extending in the same plane and direction as the second lower horizontal support and attached to a section of the main vertical center support that is approximately one-fourth of the vertical height of the main vertical center support; a lower vertical seat support member attached to a middle section of the second lower horizontal support and extending vertically upward and attaching to the outward distal end of the middle horizontal support; the lower vertical seat support member further including a series of openings aligned vertically along its length, and including a pin for extending through one of the openings; and a seat including a downward vertically extending seat support member that fits and slides within the lower vertical seat support member, and further includes a series of openings aligned vertically along its length, wherein the openings of the lower vertical seat support member align with the openings of the downward vertically extending seat support member; and wherein the pin is used to align chosen holes of the two seat supporting members, and thereby hold the two seat supporting members at a chosen vertical height;

a set of pulleys, including left and right fixed pulleys each extending from a respective distal end of the two horizontal upper supports; left and right fixed pulleys located at each of two equidistant points extending outward from the center point of the upper main horizontal support and facing the same direction as the horizontal upper support pulleys;

left and right eyelets fixedly attached to the main vertical center support at equidistant points extending outward from the main vertical center support's vertical center line, and at equidistant vertical distances that are at approximately two-thirds of the vertical height of the main vertical center support, and further facing the same direction as the horizontal upper support pulleys;

a hydraulic cylinder;

a head band including a series of attachment members located at measured angular positions along left and right radial sections thereof;

a cable connected to an attachment member at a chosen angular position of the left radial section of the head band, then extending through the left horizontal upper support pulley, then extending through the left upper main horizontal support pulley, then extending through the left main vertical center support eyelet, then removably connected to the hydraulic cylinder, then extending through the right main vertical center support eyelet, then extending through the right upper main horizontal support pulley, then extending through the right horizontal upper support pulley; then connected to an attachment member at a chosen angular position of the right radial section of the head band;

and left and right stoppers positioned and fixed upon the cable such that each stopper is slightly above a respective eyelet, wherein the stoppers are larger in diameter than the eyelets and will stop the movement of the cables when the tension in the cable is released;

such that when a user sits in the seat and attaches the head band, the user can exercise their neck muscles by moving their head, neck, and torso in a variety of directions, and easily adjust the amount of tension desired.

* * * * *